US005232266A

United States Patent [19]

Mork

[11] Patent Number: 5,232,266

[45] Date of Patent: Aug. 3, 1993

[54] UPHOLSTERED ARTICLE OF FURNITURE WITH INTERCHANGEABLE SEATING MODULE

[76] Inventor: William J. Mork, 1129 W. Brairwood St., Marshfield, Wis. 54449

[21] Appl. No.: 557,225

[22] Filed: Jul. 24, 1990

Related U.S. Application Data

[63] Continuation-in-part of Ser. No. 384,169, Jul. 24, 1989, abandoned.

[51] Int. Cl.[5] ..... A47C 7/02

[52] U.S. Cl. ..... 297/452; 297/440

[58] Field of Search ..... 297/452, 440, 284.4, 297/423, 458; 5/207, 231, 230, 235, 263

[56] References Cited

U.S. PATENT DOCUMENTS

| | | | |
|---|---|---|---|
| 316,444 | 4/1885 | Burr | 297/284 R X |
| 1,188,206 | 6/1916 | Robinson . | |
| 1,508,859 | 9/1924 | Schoenhoff . | |
| 1,527,754 | 2/1925 | Simon | 297/284 H X |
| 2,049,550 | 8/1936 | Van Dressor et al. | 297/284 R X |
| 2,333,073 | 10/1943 | Mueller | 297/440 X |
| 2,913,041 | 11/1959 | Mathison | 297/452 |
| 2,980,168 | 4/1961 | Ross | 297/452 |
| 3,167,351 | 1/1965 | Butler | 297/423 |
| 3,300,250 | 1/1967 | Dollgener et al. | 297/423 X |
| 3,653,712 | 4/1972 | Sarvas | 297/452 X |
| 3,774,966 | 11/1973 | Faulkner et al. | 297/440 |
| 3,844,613 | 10/1974 | Waldorf | 297/452 |

FOREIGN PATENT DOCUMENTS

| | | | |
|---|---|---|---|
| 7924 | 4/1905 | United Kingdom | 297/440 |

OTHER PUBLICATIONS

D. Lenckus, "Springs and Webbing," *Wood and Wood Products*, Apr. 1983, pp. 42–48.

J. D. Powell, "New Springs & Spring Constructions," *Furniture Methods & Materials*, Mar. 1974.

*Primary Examiner*—JoséV. Chen

*Attorney, Agent, or Firm*—Godfrey & Kahn

[57] ABSTRACT

An upholstered article of furniture (20) comprises a frame (26), assorted layers of padding and fabric that form upholstery (27), a backrest (29), armrests (31), cushions (33), and a seating module (10). The seating module (10) comprises a front rail (12), a back rail (14), a spring assembly (16) mounted upon the rails (12, 14), and a covering (18). The seating module (10) may be removed from and installed into a frame (26) of an article of furniture (20) as a complete unit by means of screws or other suitable attaching structure. Seating modules of different seating firmness may be interchanged (based upon consumer comfort preferences and medicinal requirements). The pitch (or tilt) of the seating module can be varied by changing the relative heights of the front rail (12) and back rail (14). For the case of sofas, the seating module (10) can be sized to be interchangeable with standard sleeper mechanisms.

7 Claims, 6 Drawing Sheets

UPHOLSTERED ARTICLE OF FURNITURE WITH INTERCHANGEABLE SEATING MODULE

CROSS-REFERENCE TO RELATED APPLICATION

This patent application is a continuation-in-part of pending U.S. patent application Ser. No. 07/384,169 filed on Jul. 24, 1989, now abandoned.

FIELD OF THE INVENTION

This invention relates generally to construction of upholstered furniture, and specifically to a construction that allows interchangeability of parts to alter the firmness or pitch (tilt) of the seat, or, in the additional case of a sofa, to allow interchangeability of a seating module with a sleeper mechanism.

BACKGROUND OF THE INVENTION

Upholstered furniture such as sofas, love seats, and chairs are typically constructed with a number of springs of a certain gauge that define a seating firmness. Given a range of height or weight parameters of the consumer, or additional medical or comfort considerations, a sofa of particular seating firmness or pitch (tilt) may be preferred by a given consumer. However, having chosen a piece of upholstered furniture for a particular pattern or design, the consumer may find that the seating firmness and/or pitch does not match his or her preferences. Where such is the case, the seating firmness cannot ordinarily be changed due to the fact that the springs that define the seating firmness and tilt are individually and permanently attached to the frame of the upholstered furniture. Conversely, for the same reasons, a consumer that prefers a particular seating firmness or tilt may be unable to find a pattern or design that matches his or her interior design needs.

It would be entirely possible for a family or a group of users to have a mixed preference for both firm and soft seats. Given the above listed constraints, however, it would not be possible for a family or group of users to have more than one seating firmness or pitch within the same piece of furniture. For example, it would not be possible in a sofa or love seat to have one portion of the seat to be firm and another soft.

From the perspective of the furniture dealer, the necessity of stocking furniture with varying degrees of firmness multiplies the amount of available stock that the dealer must keep on hand, or the dealer must, in the alternative, forego sales to prospective customers that have preferences in seating firmness that are different from what the store has stocked.

For the case of sofas, sofas are constructed to have a permanent coil deck. Sleepers have a mechanism which folds out to become a bed. Because both sofa and sleeper types have their own respective markets, it is necessary for furniture stores to stock both types. Thus, a furniture store may find it necessary to stock sofa and sleeper types in identical upholstered patterns and to stock an adequate variety of different patterns in each of the two types, as well as maintaining stock on pattern-coordinated love seats, chairs, stools, etc. As may be apparent, the stocking of sofas having permanent coil decks and sofas having sleeper mechanisms adds a significant inventorial burden to furniture stores.

Accordingly, a need has existed for a single type upholstered furniture construction that allows the seating firmness and pitch to be readily changed or customized, and, for the case of sofas, to allow for interchangeability of a coil seating module with a sleeper mechanism. Thus, a single sofa may be customized to purchaser or consumer preference for a seating firmness and be comfort pitched. Separate modules may even offer different firmness and/or comfort pitch within the seats of one sofa. The same sofa is interchangeable to a sleeper. Therefore, one floor item for a furniture store offers all of these options. These options are currently only available if the dealer stocks a distinct unit for each customer preference.

SUMMARY OF THE INVENTION

In accordance with the present invention, an article of upholstered furniture is disclosed that allows the seating firmness to be readily altered to the preferences of a consumer by the incorporation of an interchangeable seating module. The furniture may be further customized to user requirements to have areas of different seating firmness within the same piece of furniture. In a preferred embodiment, comfort pitch is adjustable by repositioning (either higher or lower) the screws securing the rear modular rail. For the case of sofas, the seating module is sized so that the seating module is interchangeable with a sleeper mechanism. The seating module is preferably comprised of a front rail and back rail. Flex bars to which coils springs of a pre-selected number and gauge have been attached are mounted across the front and back rails. The springs are then covered with a cushioning and/or decking material. The coil seating module is dimensioned to fit within a cavity formed by the frame of the upholstered furniture. The seating module is then secured to the furniture frame by screws or other appropriate securing means.

The seating module is removable from the furniture frame and is interchangeable with another seating module having a different seating firmness. The seating module may be sized so that in upholstered furniture of great enough length, for example a sofa or love seat, more than one module may fit within the furniture frame. Thus different portions of the seating area in such furniture may be customized to have varying degrees of firmness and/or pitch. For the case of sofas, the seating module (or modules) are sized to allow interchangeability of a seating module or modules with a sleeper mechanism.

The seating module allows for post-production conversion capability as between different modules by means of a simple removal and re-installation of the different seating modules. The furniture dealer is thus allowed to maintain a substantially reduced or more diverse inventory. The customer, on the other hand, is afforded options in the selection of seating firmness or pitch not otherwise available. By making the invention modular in nature, the seating module can be changed or substituted at any time during the lifetime of the furniture. Where repair of the furniture is required, such repair is facilitated by the ease by which the seating module can be removed and installed. Because of the ease of such repairs, more repairs can be done at the retail level, thus reducing the amount of time the customer is without his or her furniture.

The present invention also results in a more standardized assembly process. Production is therefore more efficient in that all frames for a given piece of furniture would be manufactured alike, and costs would decrease by the standardization of the parts.

Further objects, features, and advantages of the invention will be apparent from the following detailed description taken in conjunction with the accompanying drawings.

DESCRIPTION OF THE PREFERRED EMBODIMENT

Figure 1:
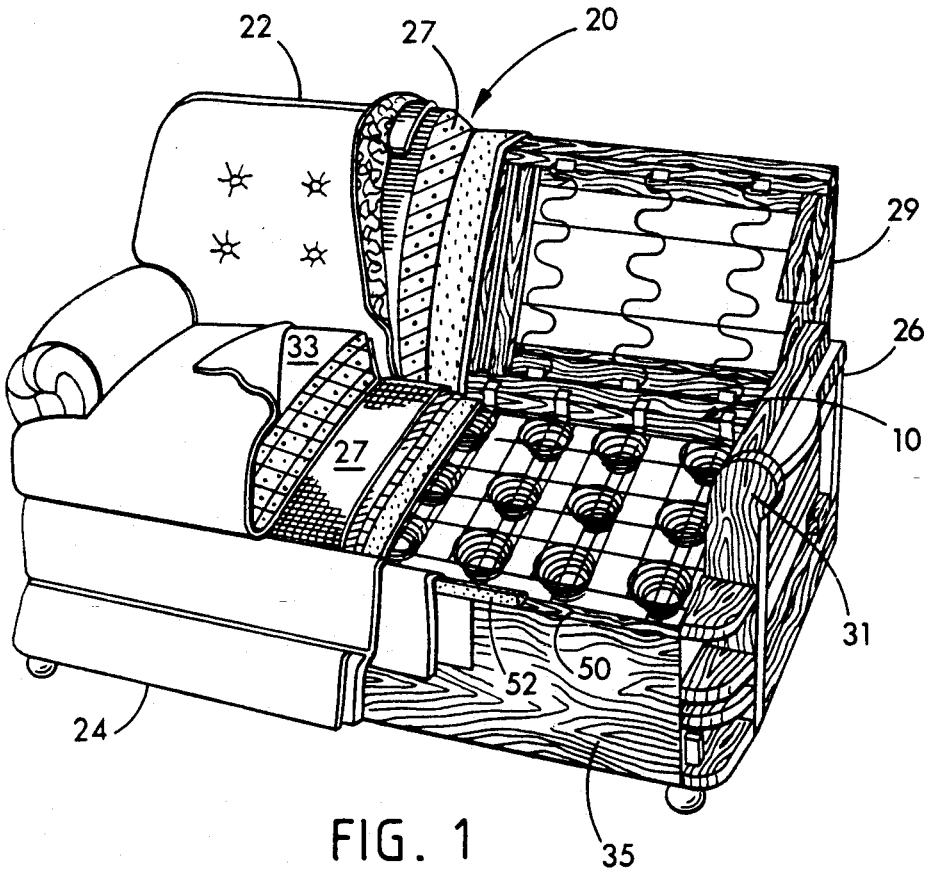
FIG. 1 is a perspective view of an article of upholstered furniture in accordance with the present invention, the article of upholstered furniture being partially cut away to show the arrangement of parts within.

With reference to the drawings, an article of upholstered furniture is shown generally at 20 in FIG. 1. The article of furniture 20 has a top 22 and a bottom 24, and comprises a frame 26, assorted layers of padding and fabric that form upholstery 27, a backrest 29, armrests 31, cushions 33, and a seating module 10. The frame 26 comprises a first set of parallel beams 28 and a second set of parallel beams 30. The sets of beams 28 and 30 are joined to form a rectangular cavity 32 that is oriented from the top 22 to the bottom 24 of the article of furniture 20. The seating module 10 is sized to fit within the rectangular cavity 32 of the frame 26 and insertable within the cavity 32 as a single unit.

The first set of parallel beams 28 comprise a forward beam 35 and a rearward beam 37 the second set of parallel beams 30 comprises a left beam 39 and a right beam 41. The backrest 29 extends upwardly from the rearward beam 37 and is oriented from the top 22 to the bottom 24 of the article of furniture 20. One of the armrests 31 extend upwardly from each of the left and right beams 39 and 41. The backrest 29 supports the back and the cushions 33 support the seat of a person in the sitting position. The arms of a person may likewise be supported upon the armrests 31.

Figure 2:
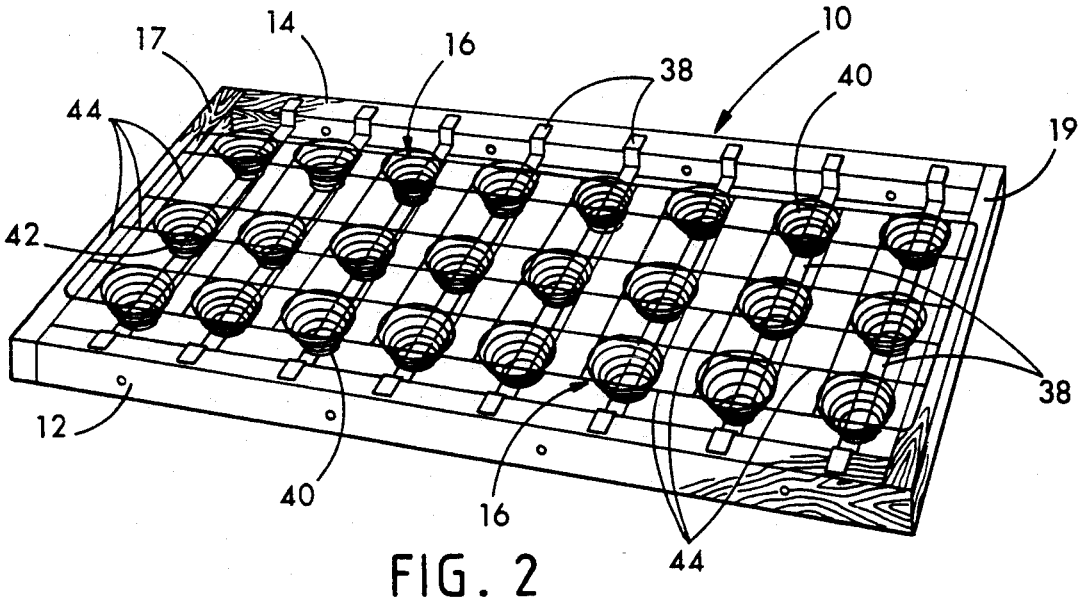
FIG. 2 is a top perspective view of a seating module used in the present invention before attachment and fitting of the felt cushion and cotton decking material.
Figure 4:
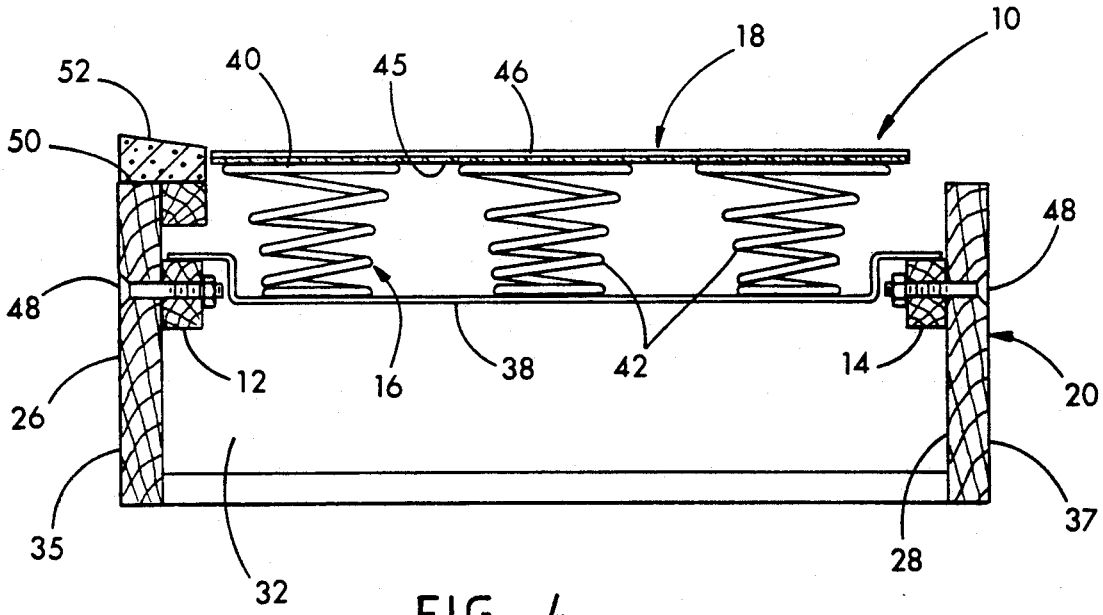
FIG. 4 is a cross-section of the frame of the article of upholstered furniture with the seating module installed.

The seating module 10 comprises a front rail 12, a back rail 14, a spring assembly 16, and a covering 15. The seating module 10 may optionally comprise side rails 17 and 19 for purposes of strength and stability. The front rail 12 and the back rail 14 are parallel in orientation. The spring assembly 16 is mounted upon the rails 12 and 14 and acts to support and bias the weight of a person sitting upon the article of furniture 20. As depicted in FIGS. 2 and 4, the spring assembly 16 preferably includes struts or flex bars 38 that span the distance between the rails 12 and 14 and are securely mounted thereto by screws or other suitable attaching means. The spring assembly 16 further includes coil spring units 40 that are attached to the struts 38. The coil spring units 40 include coil springs 42 and a wire grid 44 attached to the springs 42 to create a flat surface that biases the weight of a seated person by the coil springs 42. The coil spring units 40 are commercially available from Barber Manufacturing Company, Inc. The coil springs 42 are of pre-selected quantity and gauge, thus providing a seating module 10 of desired seating firmness. It should be apparent that coil springs 42 of different gauges and number may be used in the manufacture of the seating module 10 so as to create modules varying in seat firmness. It is noted that alternate spring assemblies may be used, for example, leaf springs, helical springs, or elastic strapping and are considered within the scope of the present invention.

Figure 3:
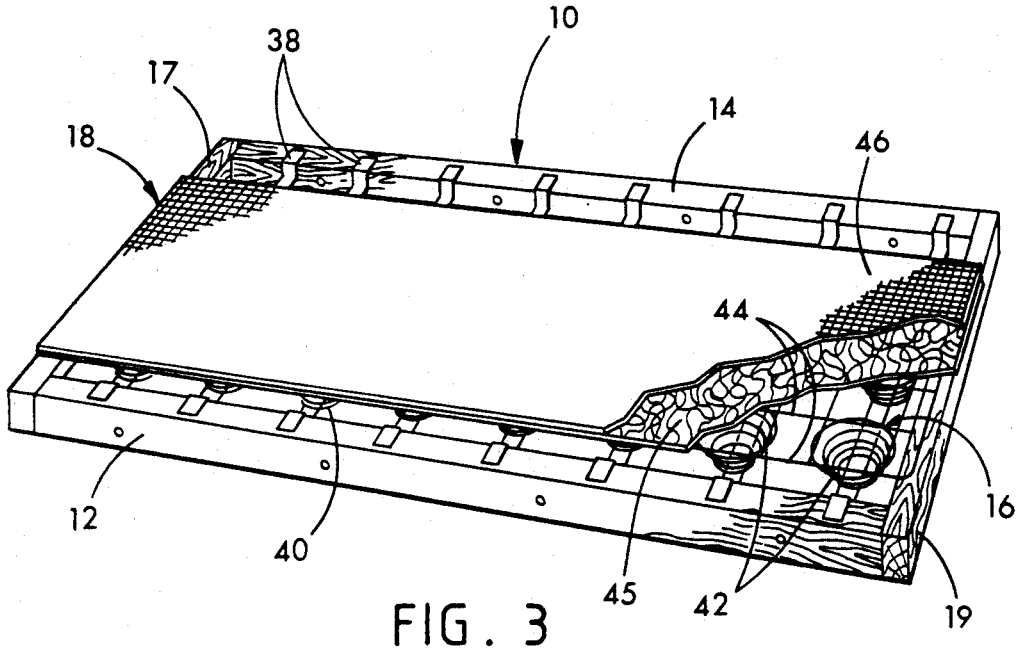
FIG. 3 is a top perspective view of the seating module used in the present invention after attachment of the felt cushion and cotton decking material.

FIG. 3 shows a top perspective view of the seating module 10 with struts 38 attached to rails 12 and 14, coil springs 42 attached to the struts 38, and the covering placed upon the wire grid 44. The covering 18 includes a midbond felt cushion 44 and cotton decking material 46 that is then attached to the coil spring units 40 by crimp gun staples. The completed seat module 10 as depicted in FIG. 3 may be inserted as a unit within the frame 26 of the article of furniture 20. FIG. 4 shows a cross-section of the frame 26 with the seating module 10 installed within the article of furniture 20.

Figure 5:
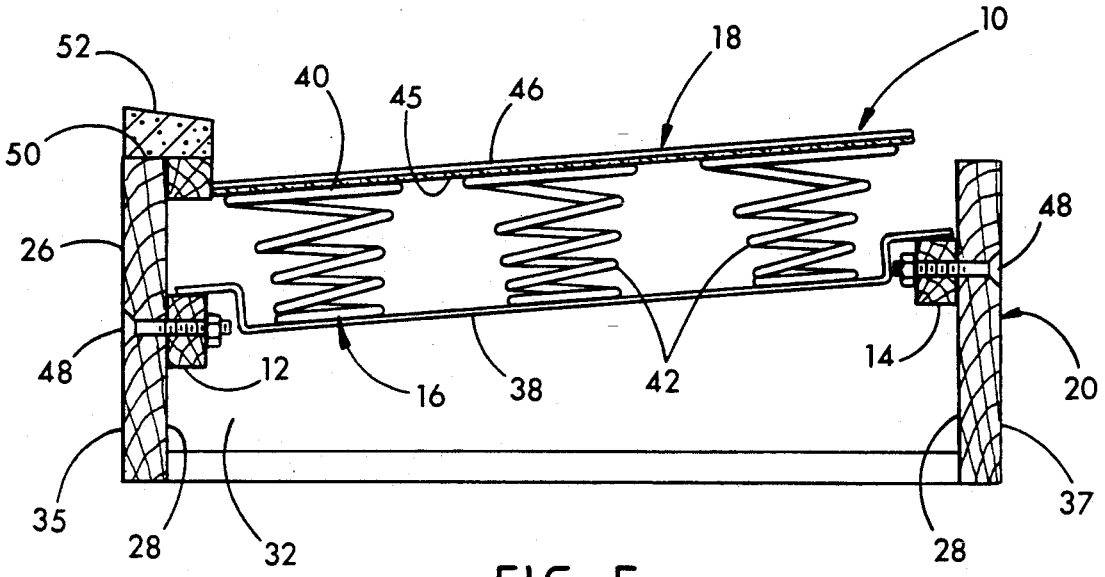
FIG. 5 is a cross-section of the frame of the upholstered furniture with the seating module installed to tilt forward.
Figure 6:
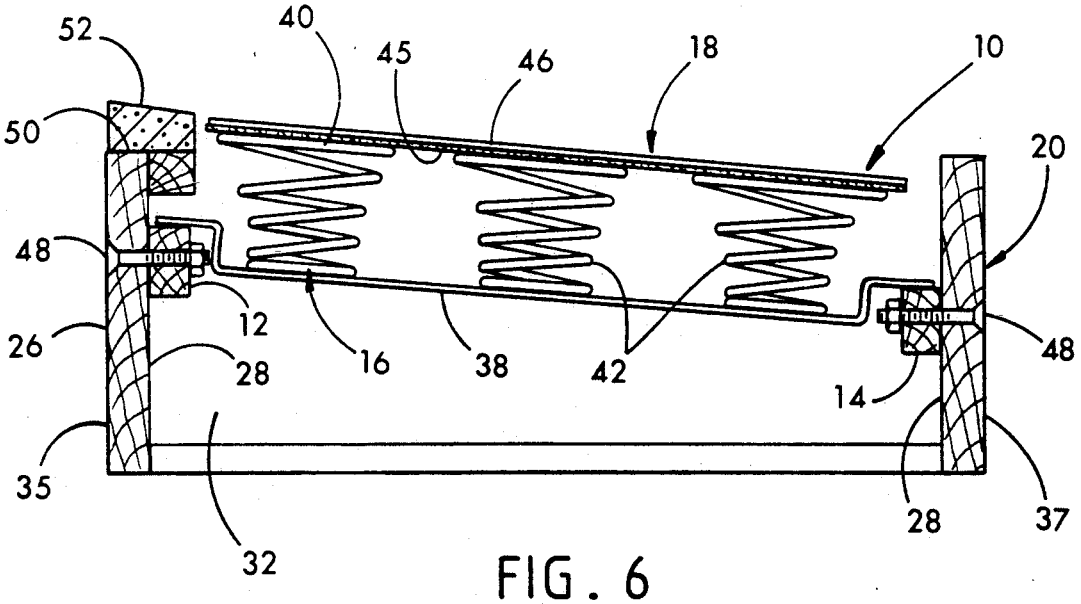
FIG. 6 is a cross-section of the frame of the upholstered furniture with the seating module installed to tilt backward.

The seating module 10 is then attached to the frame 26 by screws 48 that extend through the rail 12 into one of the beams of the set 28, and by screws 48 that extend through the rail 14 into the other of the beams of the set 28. Attachment means other than screws may be employed so long as the seating module 10 is removable and not permanently attached to the frame 26. The pitch (or tilt) of the seating module 10 may be altered simply by changing the angle at which the module 10 is attached within the frame 26. To tilt the seating module forward, the rail 14 would need to be attached to its respective beam of the set 28 higher than that of the rail 12. To tilt the seating module backward, the rail 12 would need to be attached to the respective beam of the set 28 higher than that of the rail 14. Pitch is thus adjustable by changing the relative positions of the rails 12 and 14 as they are attached to the set of beams 28. FIGS. 5 and 6 show the creation of tilt by changing the relative positions of the rails 12 and 14. FIG. 5 shows the frame 26 of the article 20 with the seating module 10 installed to tilt forward; FIG. 6 shows the seating module 10 installed to tilt backward.

Figure 7:
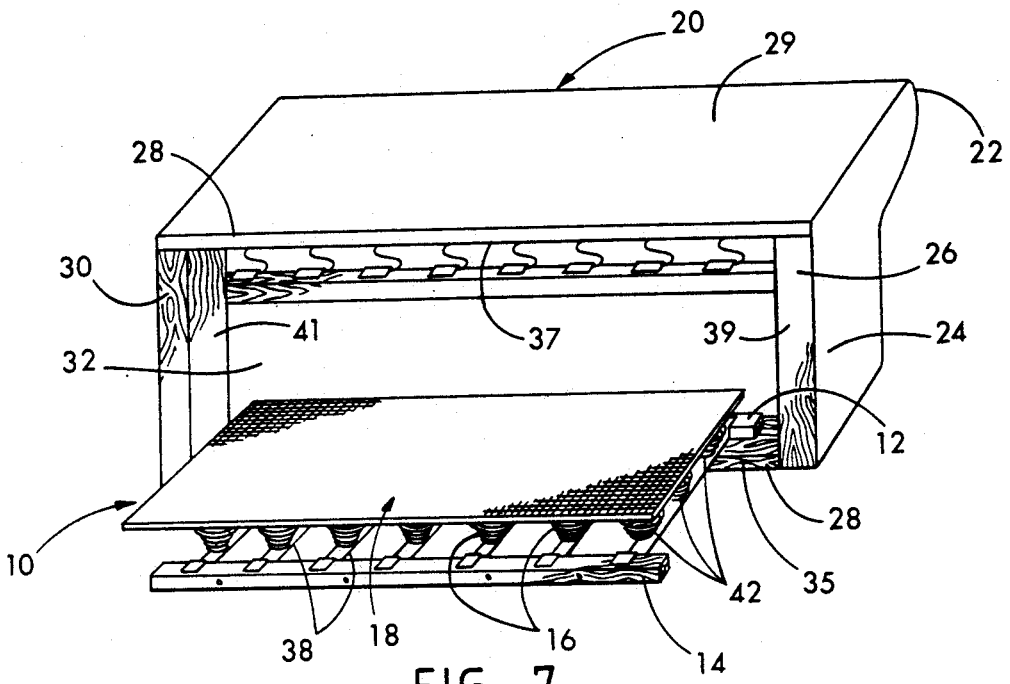
FIG. 7 a perspective view of the underside of a sofa having a cavity formed by its frame that is dimensioned to receive the seating module, and the seating module positioned nearby for installation within the frame.

By exterior appearance, the article of furniture 20 o the present invention is of similar appearance to the furniture of the prior art. The article 20 may have different designs or patterns of upholstery, and, after the seating module 10 is installed within the frame 26, cushions 33 would typically be placed upon the covering 18 of the seating module 10. The seating module 10 of the present invention thus allows interchangeability between modules 10 so that a seating module of customer-preferred seating firmness of pitch may be installed into any article of furniture 20 with a properly sized frame 26. Such customer preference may be based upon either comfort or medicinal requirements, and because of the ease that the seating module 10 can be inserted into the frame 26, such installation of the module 10 can be made by the dealer after the customer has made a decision as to his or her preference. The seating module 10 can be interchanged during the life of the article of furniture 20 for repair, or to choose an alternate seating firmness. FIG. 7 shows the installation of the seating module 10 from the bottom 24 within the cavity 32.

Figure 8:
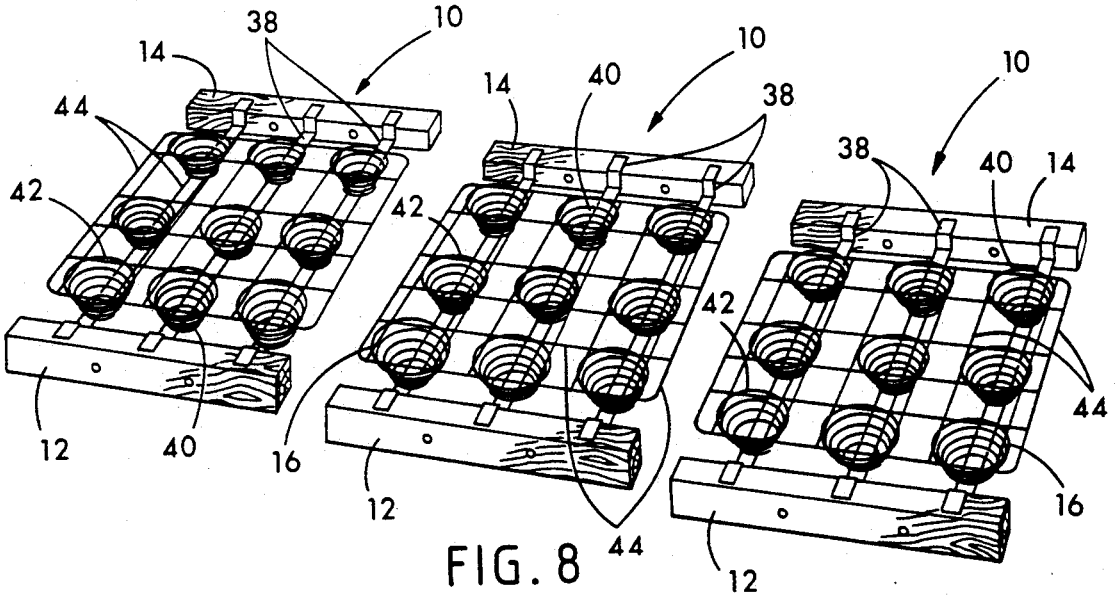
FIG. 8 is a top perspective view of three seating modules sized so as to all fit within a single cavity of an article of furniture.
Figure 9:
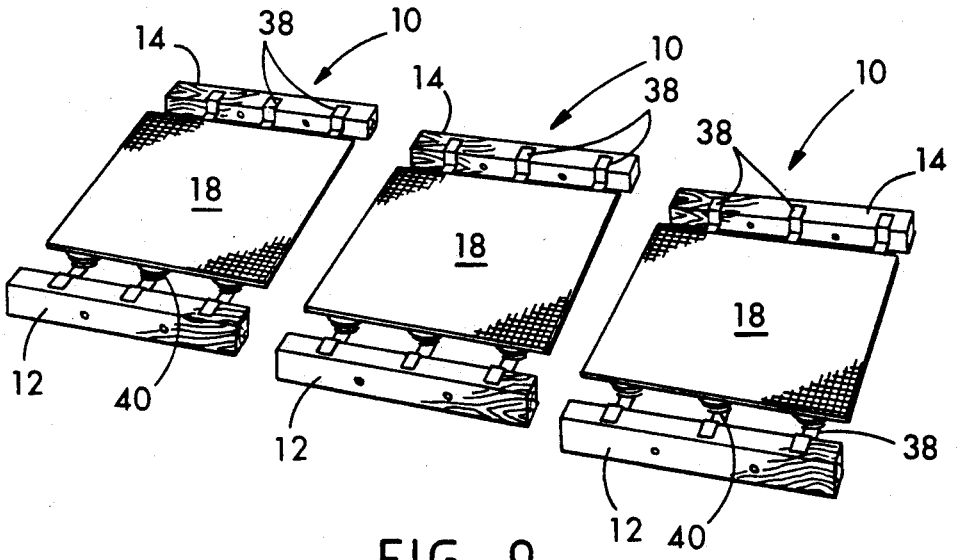
FIG. 9 is a top perspective view of three seating modules after attachment of the felt cushion and cotton decking material and sized so as to all fit within a single cavity of a frame of an article of furniture.
Figure 10:
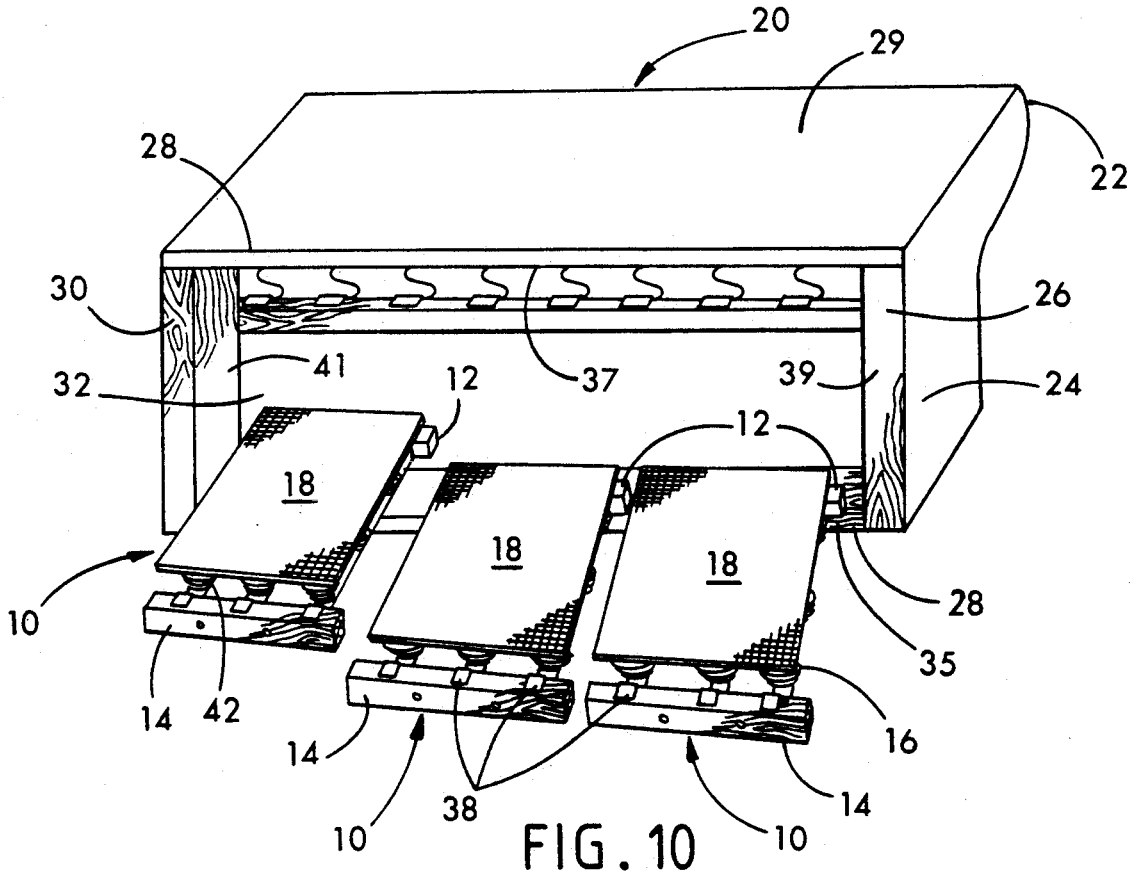
FIG. 10 is a perspective view of the underside of an article of furniture having a cavity formed by its frame that is dimensioned to receive three seating modules, and the seating modules positioned nearby for installation within the frame.

Another option available by use of the present invention in articles of furniture of great enough length, for example in sofas and love seats, is to size the seating module 10 so as to fit between the set of beams 28, but short enough to allow a multiple of seating modules to fit in the cavity 32 between the set of beams 30 of the frame 26. In a sofa, for example, three seating modules 10 could be individually attached to the frame 26. Each of these modules 10 could vary in seating firmness and/or pitch. Thus, an article of furniture 10 could be customized to have seating regions of different firmness and pitch. As noted earlier, firmness is dictated by the number and gauge of the coil springs 42 and pitch is determined by the height of the rails 12 and 14 relative to each other. FIGS. 8, 9, and 10 show the use of three modules that are individually attached in the frame 26 to vary the pitch or firmness as between the modules.

The forward beam 35 of the first set of parallel beams 28 has a top surface 50 (best seen in FIG. 1) such that the cushions 33 that are placed atop the covering 18 of the seating module 10 overhang the top surface 50 as well as the covering 18. The top surface 50 has a foam wedge 52 attached thereto that extends across the length of the forward beam 35. The foam wedge 52 is preferably made of high density polyurethane and provides a "soft edge" on the top surface 50 of the forward beam 35. Such a "soft edge" formed by the attachment of the foam wedge 52 to the top surface 50 has a decided comfort advantage to the person sitting in the article of furniture 20 over a "hard edge" that lacks the foam wedge 52. It is to be understood that the foam wedge 52 may be shaped in a number of different shapes and may be made by materials other than high density polyurethane.

For the case of sofas, the seating module 10 (and associated frame 26 into which the module 10 fits) can be sized to allow interchangeability of the seating module 10 with a sleeper mechanism. Such sleeper mechanisms are known in the prior art and constitute a bed that is capable of folding out of the sofa. The sleeper mechanism has a first position in which the mechanism is folded within the rectangular cavity 32 and a second position in which the mechanism unfolds to form a bed. The sleeper mechanism includes two parallel rails (analogous to the rails 12 and 14 of the seating module 10) that fit within one of the sets of parallel beams 28 or 30. A flat surface is formed when the mechanism is in the first, or folded, position to support and bias the weight of a person sitting upon the article of upholstered furniture 20. The cushions 33 rest atop the flat surface of the sleeper mechanism to provide support for the seat of a person in a sitting position. Where the sleeper mechanism has been substituted for the seating module 10, the cushion 33 overhangs such that it rests atop the top surface 50 of the forward beam 35 as well as the flat surface of the sleeper mechanism. The article of furniture 20 with the sleeper mechanism substituted for the seating module may incorporate the foam wedge 52 such as previously described to give a "soft" edge. Thus, a sleeper mechanism can be removed and replaced with a seating module 10, or vice versa, or assembly of the sofa can be postponed until the customer makes his or her choice.

Figure 11:
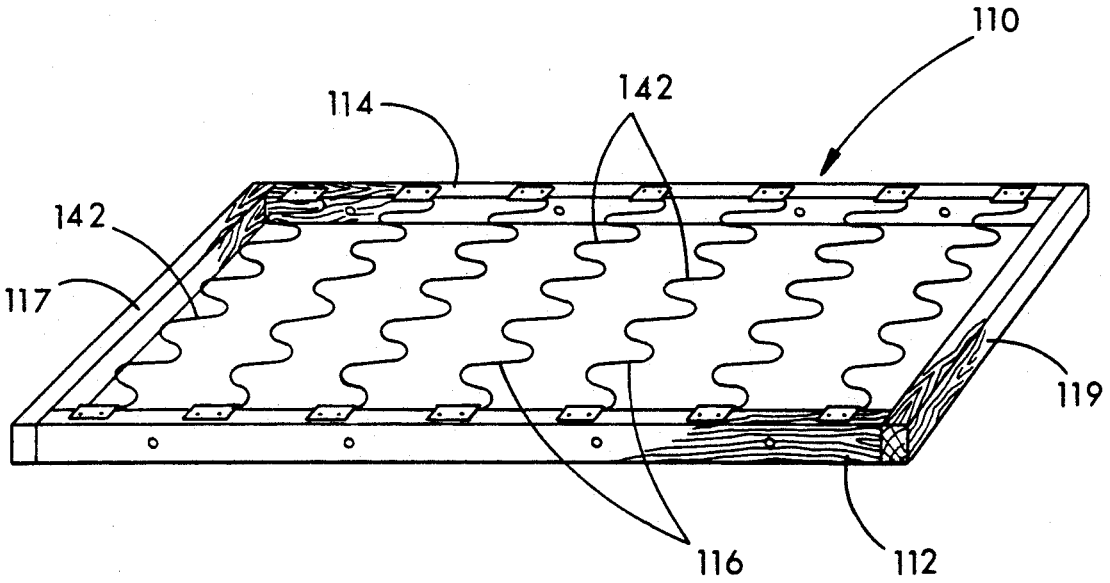
FIG. 11 is a top perspective view of an alternate seating module that may be used in the present invention.

FIG. 11 shows an alternate seating module 110 that may be used in the present invention. The seating module 110 comprises a front rail 112, a back rail 114, and a spring assembly 116. The seating module 110 may optionally comprise side rails 117 and 119 for purposes of strength and stability. The front rail 112 and the back rail 114 are parallel in orientation. The spring assembly 116 is mounted upon the rails 112 and 114 and acts to support and bias the weight of a person sitting upon the article of furniture 20. The spring assembly 116 includes a plurality of individual sinuous or loop-type springs 142 that span the distance between the rails 112 and 114 and are securely mounted thereto. The individual sinuous or loop-type springs 142 are characterized by a wire that bends back and forth in the same plane. The springs 142 are of pre-selected quantity and gauge, thus providing a seating module 110 of desired seating firmness. It should be apparent that coil springs 142 of different gauges and number may be used in the manufacture of the seating module 110 varying in seat firmness. The seating module 110 may incorporate a midbond felt cushion and cotton decking such as was the case for the seating module 10, and may be attached to the frame 26 in the same manner as seating module 10 by screws that extend through the rails 112 and 114 into the forward and rearward beams 35 and 37. As noted earlier, alternate spring assemblies may be used and are considered within the scope of the present invention.

It is understood that the invention is not confined to the particular construction and arrangement of parts herein illustrated and described, but embraces such modified forms thereof as come within the scope of the following claims.

What is claimed is:

1. An article of upholstered furniture used to support the back and the seat of a person in a sitting position, the article having a top and a bottom and the article comprising:

(a) a frame having first and second sets of parallel beams that are joined to form a rectangular cavity such that the rectangular cavity is oriented from the top to the bottom of the article, the first set of beams including a forward beam and rearward beam and the second set of beams including a left beam and a right beam;

(b) a backrest that extends upwardly from the rearward beam and is oriented from the top to the bottom of the article of furniture, the backrest providing support for the back of a person in a sitting position;

(c) an armrest that extends upwardly from one of the second set of beams;

(d) a seating module that is sized to fit within the rectangular cavity of the frame and removably attached within the cavity from the bottom as a single unit, wherein the bottom has an uninterrupted clearance to permit the removal and attachment of the seating module to the cavity from the bottom, the seating module including:

(i) two parallel rails that fit within one of the sets of parallel beams;

(ii) a coil spring assembly mounted upon the rails to support and bias the weight of a person sitting upon the article;

(iii) a covering that fits over the spring assembly between the spring assembly and the person sitting upon the article, the rails, coil spring assembly, and covering forming a unit which is independent of the frame;

(e) means for removably attaching the rails of the seating module to one of the sets of the parallel beams;

(f) a cushion that rests atop the covering to provide support for the seat of a person in a sitting position, wherein the forward beam has a top surface and wherein the cushion overhangs such that it rests atop the top surface as well as the covering, the top surface having a foam wedge that is attached thereto; and (g) upholstery which fits about the frame, the backrest, and the armrest, wherein the seating module is substantially sized similarly to a sleeper mechanism, the article of upholstered furniture being thereby convertible to include either a sleeper mechanism or seating modules of various seating firmnesses at the discretion of the user, and further wherein the rails of the seating module are removably attached to the parallel beams by the means for removably attaching the rails in a manner to adjust the angle and the height o the seating module at the discretion of the user by changing the relative heights of the front rail and the back rail.

2. The article of claim 1 wherein the foam wedge is made of high density polyurethane.

3. The article of claim 1 wherein the spring assembly includes struts that spa the distance between the two parallel rails and a spring attached to the struts.

4. The article of claim 1 wherein the means of attaching are screws.

5. The article of claim 1 wherein there are multiple seating modules that each fill a portion of the cavity and wherein each of the spring assemblies of the different modules include a spring that may be individually chosen to have a particular spring constant so that the article may have seating modules of varying seating firmness.

6. The article of claim 1 wherein there are multiple seating modules that each fill a portion of the cavity, and wherein each of the different modules may be individually attached to one of the sets of parallel beams a pre-selected angles so that the article may have seating modules of varying pitch.

7. A kit for making an article of upholstered furniture used to support the back and the seat of a person in a sitting position, the article having a top and a bottom and the kit comprising the combination of:

(a) a frame having first and second sets of parallel beams that are joined to form a rectangular cavity such that the rectangular cavity is oriented from the top to the bottom of the article, the first set of beams including a forward beam and a rearward beam and the second set of beams including a left beam and a right beam;

(b) a backrest that extends upwardly from the rearward beam and is oriented from the top to the bottom of the article of furniture, the backrest providing support for the back of a person in a sitting position;

(c) an armrest that extends upwardly from one of the second set of beams;

(d) a seating module that is sized to fit within the rectangular cavity of the frame and removably attached within the cavity from the bottom as a single unit, wherein the bottom has an uninterrupted clearance to permit the removal and attachment of the seating module to the cavity from the bottom, the seating module including:

(i) two parallel rails that fit within one of the sets of parallel beams;

(ii) a coil spring assembly mounted upon the rails to support and bias the weight of a person sitting upon the article;

(iii) a covering that fits over the spring assembly between the spring assembly and the person sitting upon the article, the rails, the coil spring assembly, and the covering forming a unit which is independent of the frame;

(e) means for removably attaching the rails of the seating module to one of the sets of the parallel beams;

(f) a cushion that rests atop the covering to provide support for the seat of a person in a sitting position; and (g) upholstery which fits about the frame, the backrest, and the armrest, wherein the seating module is substantially sized similarly to a sleeper mechanism, the article of upholstered furniture being thereby convertible to include either a sleeper mechanism or seating modules of various seating firmnesses at the discretion of the user, and further wherein the rails of the seating module are removably attached to the parallel beams by the means for removably attaching the rails in a manner to adjust the angle and height of the seating module at the discretion of the user.

* * * * *